US008435160B1

(12) United States Patent
Clum et al.

(10) Patent No.: US 8,435,160 B1
(45) Date of Patent: May 7, 2013

(54) SHOCK-ABSORBING TREADMILL

(76) Inventors: Gerald M. Clum, Waverly, PA (US); David Hazzouri, Scranton, PA (US)

( * ) Notice: Subject to any disclaimer, the term of this patent is extended or adjusted under 35 U.S.C. 154(b) by 0 days.

(21) Appl. No.: 13/501,961

(22) Filed: Apr. 13, 2012

Related U.S. Application Data

(63) Continuation of application No. PCT/US2012/024107, filed on Feb. 7, 2012.

(60) Provisional application No. 61/440,106, filed on Feb. 7, 2011.

(51) Int. Cl.
*A63B 22/02* (2006.01)

(52) U.S. Cl.
USPC ..... 482/54

(58) Field of Classification Search ..... 482/54
See application file for complete search history.

(56) References Cited

U.S. PATENT DOCUMENTS

| | | | | |
|---|---|---|---|---|
| 4,548,405 | A | 10/1985 | Lee et al. | |
| 4,938,473 | A | 7/1990 | Lee et al. | |
| 4,974,831 | A | 12/1990 | Dunham | |
| 4,984,810 | A | 1/1991 | Stearns et al. | |
| 5,029,801 | A | 7/1991 | Dalebout et al. | |
| 5,184,988 | A | 2/1993 | Dunham | |
| 5,203,800 | A | 4/1993 | Meredith | |
| 5,279,528 | A | 1/1994 | Dalebout et al. | |
| 5,336,146 | A | 8/1994 | Piaget et al. | |
| 5,542,892 | A | 8/1996 | Buhler | |
| 5,626,539 | A | 5/1997 | Piaget et al. | |
| 5,827,155 | A * | 10/1998 | Jensen et al. | 482/54 |
| 6,045,490 | A * | 4/2000 | Shafer et al. | 482/54 |
| 6,179,753 | B1 | 1/2001 | Barker et al. | |
| 6,953,418 | B1 | 10/2005 | Chen | |
| 7,344,481 | B2 * | 3/2008 | Watterson et al. | 482/54 |
| 8,118,888 | B2 * | 2/2012 | Molter et al. | 48/54 |
| 2001/0016543 | A1 | 8/2001 | Dalebout | |
| 2003/0073545 | A1 | 4/2003 | Liu et al. | |
| 2004/0242378 | A1 | 12/2004 | Pan et al. | |
| 2005/0164839 | A1 * | 7/2005 | Watterson et al. | 482/54 |
| 2006/0287163 | A1 | 12/2006 | Wang | |
| 2007/0049465 | A1 | 3/2007 | Wu | |
| 2007/0225127 | A1 | 9/2007 | Pan et al. | |
| 2012/0178590 | A1 * | 7/2012 | Lu | 482/54 |

FOREIGN PATENT DOCUMENTS

| | | | |
|---|---|---|---|
| WO | 9211905 | A1 | 7/1992 |

OTHER PUBLICATIONS

Bowflex® TreadClimber® TC5000 (among other models) (http://www.treadclimber.com/trc_microsite/productinformation/tc5000/prdcdovr~100122/Bowflex+TreadClimber +TC5000.jsp). Downloaded Oct. 14, 2008.

Wikipedia Article on Carbon Steel and Mild Steel http://en.wikipedia.org/wiki/Carbon_steel Downloaded Oct. 15, 2008.

* cited by examiner

*Primary Examiner* — Stephen Crow
(74) *Attorney, Agent, or Firm* — Gerry J. Elman; Elman Technology Law P.C.

(57) ABSTRACT

A treadmill having one or more air springs attached to the underside of the treadmill and one or more wheels on the underside of the treadmill near the back end of the treadmill, to provide increased shock-absorption over conventional treadmills. Other embodiments disclosed herein include treadmills with the above-discussed components as well as one or more air compressors, pressure sensors, and/or weight sensors for adjusting the level of pressure in the one or more air springs, based on the weight of a person using such a treadmill.

11 Claims, 8 Drawing Sheets

SHOCK-ABSORBING TREADMILL

TECHNICAL FIELD

The present disclosed subject matter relates to exercise treadmills and more specifically to a shock absorbing frame for a treadmill.

BACKGROUND ART

Cardiovascular exercise, also known as cardiorespiratory exercise or aerobic exercise focuses on the human body's use of oxygen in metabolic processes and strengthening slow-twitch muscles. To stimulate these physiological processes, cardiovascular exercises are performed at moderate levels of intensity for extended periods of time, relative to anaerobic exercises which focus on building fast-twitch muscle. Cardiovascular exercise has been linked to many benefits including the prevention of heart disease and diabetes, rebuilding of lung tissue after quitting smoking, improved circulation, reduction of cholesterol and fat, more efficient use of oxygen, increased endurance, improved mental health, and a greater life span.

Perhaps the oldest and most popular form of cardiovascular exercise is running. Scientists estimate that the human body first developed the ability to run roughly four and a half million years ago in order to hunt and escape from animals. Evidence of running as a sport dates back, at least, to the Tailteann Games of Ireland in 1829 BC. Now, running is a ubiquitous sport with a place in the Olympics, high school and college-level athletics, various marathons around the world, and casual running. As compared to other cardiovascular exercises, such as swimming, in-line skating, or bicycling, it can be done almost anywhere and requires no special equipment. However, running outdoors has certain drawbacks that running on specialized equipment such as a treadmill does not.

Treadmills, which simulate a moving terrain, in many instances give the runner the ability to set the speed as well as the incline or decline of the terrain. Further, a treadmill can be located in a relatively small space, making indoor running possible. This is advantageous because indoor conditions can be controlled whereas outdoor conditions, such as rain, snow, ice, and extreme temperatures can make running uncomfortable or unsafe. A further advantage provided by mechanisms integrated into certain expensive high-end treadmills is providing a simulated terrain that gives under the weight of a runner more than many outdoor surfaces do. Given that running as a cardiovascular exercise involves repeated impact over an extended period of time, reducing the impact on the body from each stride decreases the likelihood of impact-related injuries such as patellar tendonitis.

DISCLOSURE OF INVENTION

The present disclosed subject matter provides a treadmill having at least one air spring attached to the underside of the treadmill for absorbing or mitigating the shock on the human body incurred during running on the treadmill. In preferred embodiments, two air springs are located under the front end of the treadmill, one on the left and one on right side, and two more air springs are located about one third of the way from the front end of the treadmill, on the left and right side. The air springs may be attached using glue, hook-and-loop fasteners such as Velcro®, magnets, screws, nails, and/or other attachment means. In addition, certain embodiments according to the invention include a set of wheels on the underside of the treadmill at the back end. The set of wheels allows the treadmill to travel back and forth slightly as the front end of the treadmill moves up and down with each stride taken by a person exercising on the treadmill.

The treadmill as described above is targeted for a person weighing between 100 and 300 pounds. For a person weighing between 200 and 250 pounds, the optimal inflation for each of the four air springs is 5 psi. For a person weighing less than 200 pounds, the optimal psi of the air springs is less than 5 psi, and for a person over 250 pounds, the optimal inflation is more than 5 psi. In preferred embodiments, the inflation of the air springs is adjustable. In some embodiments, the air springs can each be manually inflated or deflated using an air pump and a coupling adapter, such as a needle commonly used to inflate a basketball, football, or soccer ball. Of course, other adapters to couple an air pump to an air spring are within the scope of the invention.

In certain embodiments, the treadmill includes at least one weight sensor adapted to detect the weight of a person standing on the treadmill. The at least one weight sensor may be directly underneath the upper surface of the treadmill, within one or more air springs, at the front end and/or back end of the treadmill, or any other suitable location on the treadmill. The weight sensor may be a load cell, a strain gauge, a solenoid valve, or any other suitable device known in the art. Further embodiments having a weight sensor also include a central processing unit, for example, a microchip or microcontroller ("processor") coupled to computer memory, which receives information from the weight sensor regarding the weight of a person on the treadmill. The processor then determines whether the detected air pressure in the air springs is optimal for the weight of the person, based on a lookup table having data points of weights and corresponding optimal pressure settings. In certain embodiments, if the person's weight is between two data points in the lookup table, the processor interpolates between the two data points to arrive at an optimal pressure setting.

Certain further embodiments of the invention, having the aforementioned components, also include an output device, for example a speaker and/or a visual readout, such as a liquid crystal display ("LCD"), dial, or gauge, located on a dashboard section of the treadmill, for informing the user of the optimal pressure setting for the user's weight and the current pressure setting in the one or more air springs. In still further embodiments, the treadmill includes an air compressor which is coupled to each of the air springs, and at least one pressure sensor for detecting the air pressure in the air springs. The air compressor is capable of inflating and deflating air springs it is coupled to. In certain embodiments including a processor, the processor activates the compressor to inflate or deflate the air springs to the optimal pressure based on the person's weight. Further embodiments include a control panel on the dashboard of the treadmill which is adapted to allow a person to control the air compressor to adjust the inflation of the air springs. In alternative embodiments, the treadmill does not include a dashboard and the output device and/or control panel are located elsewhere on the treadmill.

The scope of the present invention includes manufacturing a shock-absorbing treadmill in accordance with an embodiment disclosed herein, as well as retrofitting an existing treadmill to meet the description of any of the embodiments disclosed herein.

One aspect of the invention is a shock-absorbing treadmill comprising:

a treadmill having length, a front end, a back end, a left side, a right side, and an underside; and at least one air spring attached to the underside of the treadmill.

A further aspect of the invention is the shock-absorbing treadmill as disclosed above, wherein the at least one air spring attached to the underside of the treadmill is a first air spring attached to the underside of treadmill at the front end, at the left side, and a second air spring attached to the underside of the treadmill at the front end, at the right side.

A further aspect of the invention is the shock-absorbing treadmill as disclosed above, further comprising a third air spring attached to the underside of the treadmill approximately one-third of the length from the front end, at the left side and a fourth air spring attached to the underside of the treadmill approximately one-third of the length from the front end, at the right side.

A further aspect of the invention is the shock-absorbing treadmill as disclosed in any of the above aspects, further comprising at least one wheel rotatably connected to the underside of the treadmill at back end of the treadmill, whereby the treadmill is allowed to travel back and forth slightly as the front end of the treadmill moves up and down with each stride taken by a person exercising on the treadmill.

A further aspect of the invention is the shock-absorbing treadmill as disclosed immediately above, wherein the at least one wheel rotatably connected to the underside of the treadmill at the back end of the treadmill is a first wheel rotatably connected to the underside of the treadmill at the back end, at the left side, and a second wheel rotatably connected to the underside of the treadmill at the back end, at the right side.

A further aspect of the invention is the shock-absorbing treadmill as disclosed in any of the above disclosed aspects, further comprising a weight sensor adapted to sense the weight of a person on the treadmill.

A further aspect of the invention is the shock-absorbing treadmill as disclosed in any of the above disclosed aspects, further comprising at least one pressure sensor adapted to sense a pressure within the at least one air spring.

A further aspect of the invention is the shock-absorbing treadmill as disclosed in any of the above disclosed aspects, further comprising at least one air compressor coupled to the at least one air springs.

A further aspect of the invention is a shock-absorbing treadmill as disclosed above, further comprising a processor connected to a computer memory, wherein said processor is further connected to the weight sensor and an output device adapted to visually or audibly provide information, wherein said computer memory contains processor-executable instructions for:

electronically receiving information regarding a weight associated with a person located on the treadmill; and determining an optimal pressure for the at least one air springs based on the weight of the person.

A further aspect of the invention is a shock-absorbing treadmill as disclosed immediately above, wherein the computer memory further contains processor-executable instructions for:

providing information through the output device regarding the optimal pressure for the at least one air spring.

A further aspect of the invention is a shock-absorbing treadmill as disclosed above, wherein the processor is further connected to the at least one air compressor and the at least one pressure sensor, and the computer memory further includes processor-executable instructions for:

detecting the air pressure in the at least one air spring; and inflating or deflating the at least one air spring until the at least one air spring has the optimal pressure.

A further aspect of the invention is a shock-absorbing treadmill as disclosed above, further comprising a control panel attached to the treadmill and the processor, said control panel providing an interface adapted to allow a person to input a desired pressure in the at least one air spring, and wherein the computer memory further contains processor-executable instructions for:

inflating or deflating the at least one air spring until the pressure in the at least one air spring is equal to the desired pressure.

In addition, the present disclosed subject matter includes methods of adapting an existing treadmill to be a shock-absorbing treadmill.

One aspect of the present disclosed subject matter is a method of adapting an existing treadmill having a length, a front end, a back end, a left side, a right side, and an underside, to be a shock-absorbing treadmill, the method comprising:

attaching at least one air spring to the underside of the treadmill.

Another aspect of the present disclosed subject matter is a method of adapting an existing treadmill to be a shock-absorbing treadmill, as disclosed above, wherein the step of attaching at least one air spring to the underside of the treadmill comprises:

attaching a first air spring to the underside of treadmill at the front end, at the left side; and attaching a second air spring to the underside of the treadmill at the front end, at the right side.

Another aspect of the present disclosed subject matter is a method of adapting an existing treadmill to be a shock-absorbing treadmill, as disclosed above, wherein the step of attaching at least one air spring to the underside of the treadmill comprises:

attaching a first air spring to the underside of treadmill at the front end, at the left side; and attaching a second air spring to the underside of the treadmill at the front end, at the right side.

Another aspect of the present disclosed subject matter is the method of adapting an existing treadmill to be a shock-absorbing treadmill, as disclosed above, further comprising:

attaching a third air spring to the underside of the treadmill approximately one-third of the length from the front end, at the left side; and attaching a fourth air spring to the underside of the treadmill approximately one-third of the length from the front end, at the right side.

Another aspect of the present disclosed subject matter is any of the above-disclosed methods of adapting an existing treadmill to be a shock-absorbing treadmill, further comprising:

rotatably connecting at least one wheel to the underside of the treadmill at back end of the treadmill, whereby the treadmill is allowed to travel back and forth slightly as the front end of the treadmill moves up and down with each stride taken by a person exercising on the treadmill.

Another aspect of the present disclosed subject matter is the above-disclosed method of adapting an existing treadmill to be a shock-absorbing treadmill, wherein the step of rotatably connecting the at least one wheel to the underside of the treadmill at the back end of the treadmill requires at least two wheels and comprises:

rotatably connecting a first wheel to the underside of the treadmill at the back end, at the left side; and rotatably connecting a second wheel to the underside of the treadmill at the back end, at the right side.

The presently disclosed subject matter also includes methods of using shock-absorbing treadmills with features as disclosed in the aspects above.

One aspect of the presently disclosed subject matter is a method of using any of the above-disclosed shock-absorbing treadmills, comprising:

standing or exercising on the shock-absorbing treadmill.

Another aspect of the presently disclosed subject matter is a method of using any of the above-disclosed shock-absorbing treadmills, comprising:

inflating or deflating the at least one air spring until the pressure in the at least one air spring is substantially equal to a desired pressure; and standing or exercising on the shock-absorbing treadmill.

Another aspect of the presently disclosed subject matter is a method of using any of the above-disclosed shock-absorbing treadmills comprising:

determining an optimal pressure for the at least one air spring based on the weight of a person who is or will be standing or exercising on the shock-absorbing treadmill;

inflating or deflating the at least one air spring until the pressure in the at least one air spring is substantially equal to the optimal pressure; and standing or exercising on the shock-absorbing treadmill.

Another aspect of the presently disclosed subject matter is a method of using a shock-absorbing treadmill, comprising the steps in the above-recited method, wherein the step of determining an optimal pressure for the at least one air spring based on the weight of a person who is or will be standing or exercising on the shock-absorbing treadmill comprises:

standing on the shock-absorbing treadmill; and receiving from an output device on the shock absorbing treadmill information regarding the optimal pressure for the at least one air spring.

Another aspect of the presently disclosed subject matter is a method of using a shock-absorbing treadmill, comprising the steps in any of the above-recited methods of use, except the first recited method of use, wherein the step of inflating or deflating the at least one air spring until the pressure in the at least one air spring is substantially equal to the optimal pressure comprises allowing or authorizing the shock-absorbing treadmill to inflate or deflate the at least one air spring until the pressure in the at least one air spring is substantially equal to the optimal pressure.

BRIEF DESCRIPTION OF DRAWINGS

Attention is now directed to the drawing figures, where like or corresponding numerals indicate like or corresponding components. In the drawings.

MODES FOR CARRYING OUT THE INVENTION

Figure 1:
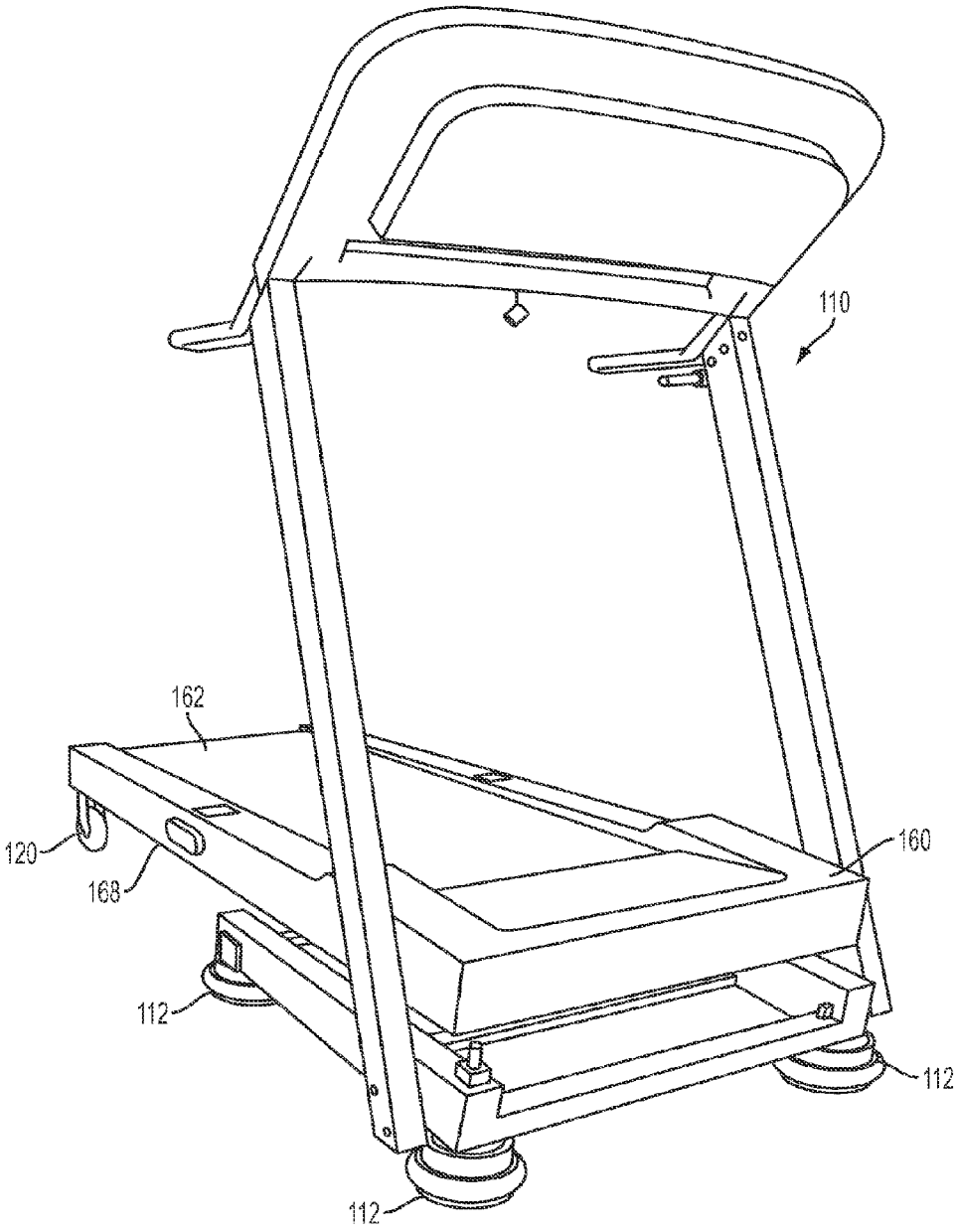
FIG. 1 is a perspective view of a first exemplary embodiment of a shock-absorbing treadmill of the present invention.
Figure 2:
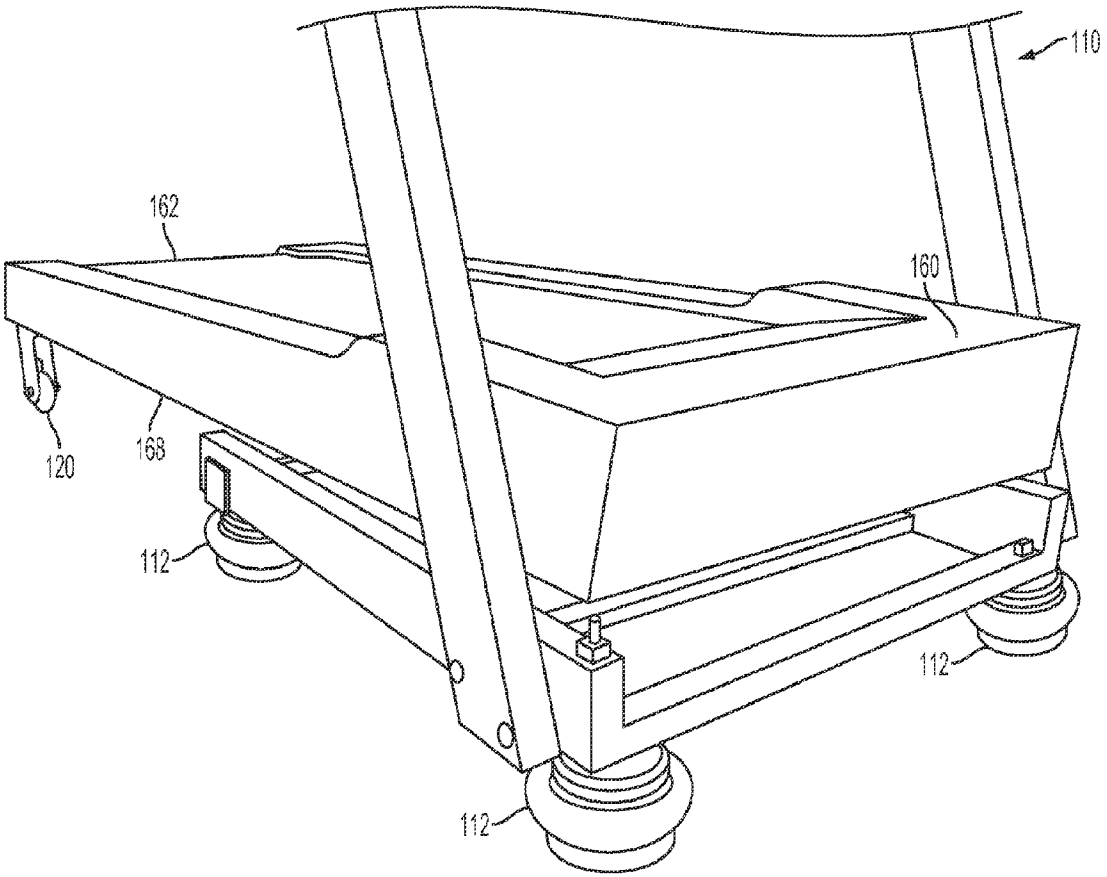
FIG. 2 is a perspective view of the lower portion of the first embodiment of the shock-absorbing treadmill of the present invention.

FIG. 1 and FIG. 2 offer perspective views of a first exemplary embodiment of a shock-absorbing treadmill 110 of the present invention. Attached to the underside 168 of the treadmill 110 are four air springs 112. Only three of the air springs 112 are visible. Near the back end 162 of the treadmill 110, rotatably mounted to the underside 168 of the treadmill 110 are two wheels 120. In these particular views, only one of the wheels 120 is visible. When a person is walking or running on the treadmill 110, the front end 160 of the treadmill 110 moves up and down with each step of the person, with the air springs 112 absorbing the shock. As the front end 160 of the treadmill 110 moves up and down, the wheels 120 allow the treadmill 110 to travel back and forth slightly.

Figure 3:
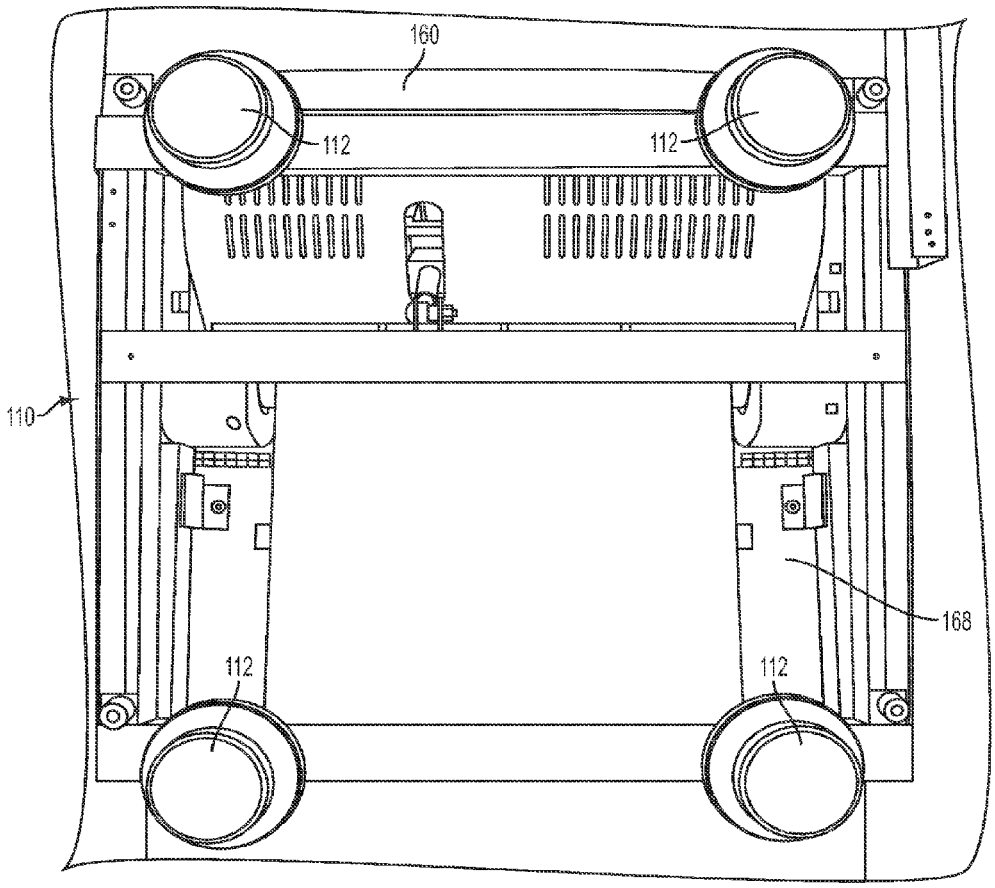
FIG. 3 is a bottom view of the front end of the first embodiment of the shock-absorbing treadmill of the present invention.

FIG. 3 is a bottom view of the front end 160 of the first embodiment of the shock-absorbing treadmill 110 of the present invention. As can be seen, the air springs 112 are located on the underside 168 of the treadmill 110. The air springs 112 are located near the front end 160, with two air springs 112 directly underneath the front end 160 and another two air springs 112 located about one third of the way from the front end 160 of the treadmill 110.

Figure 4:
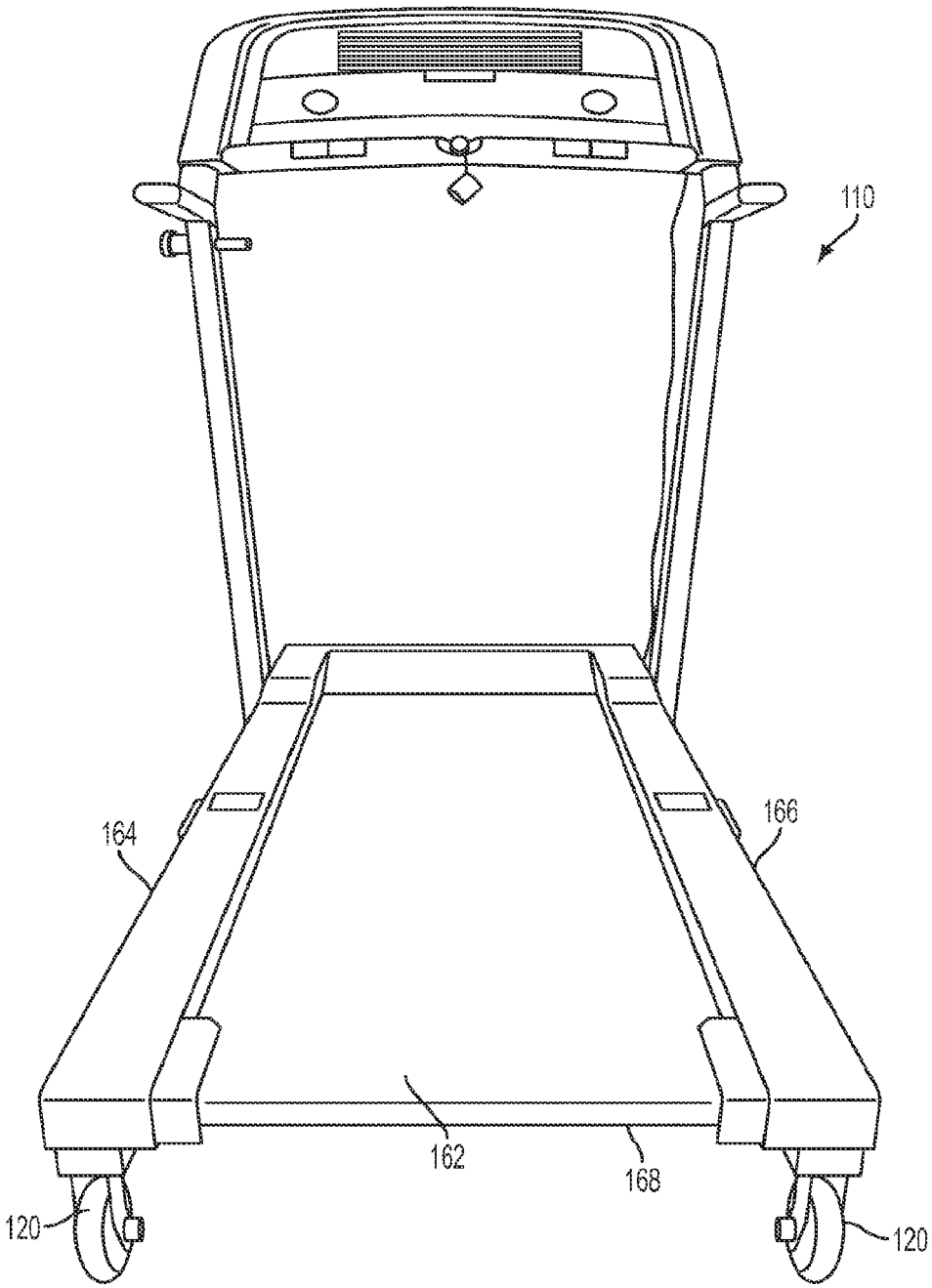
FIG. 4 is a back view of the first embodiment of a shock-absorbing treadmill of the present invention.

FIG. 4 is a back view of the first embodiment of a shock-absorbing treadmill 110 of the present invention. As can be seen from this view, the treadmill 110 has wheels 120 rotatably connected to the underside 168 of the treadmill 110, on the back end 162, with one wheel 120 on the left side 164 and another wheel 120 on the right side 166 of the treadmill 110.

Figure 5:
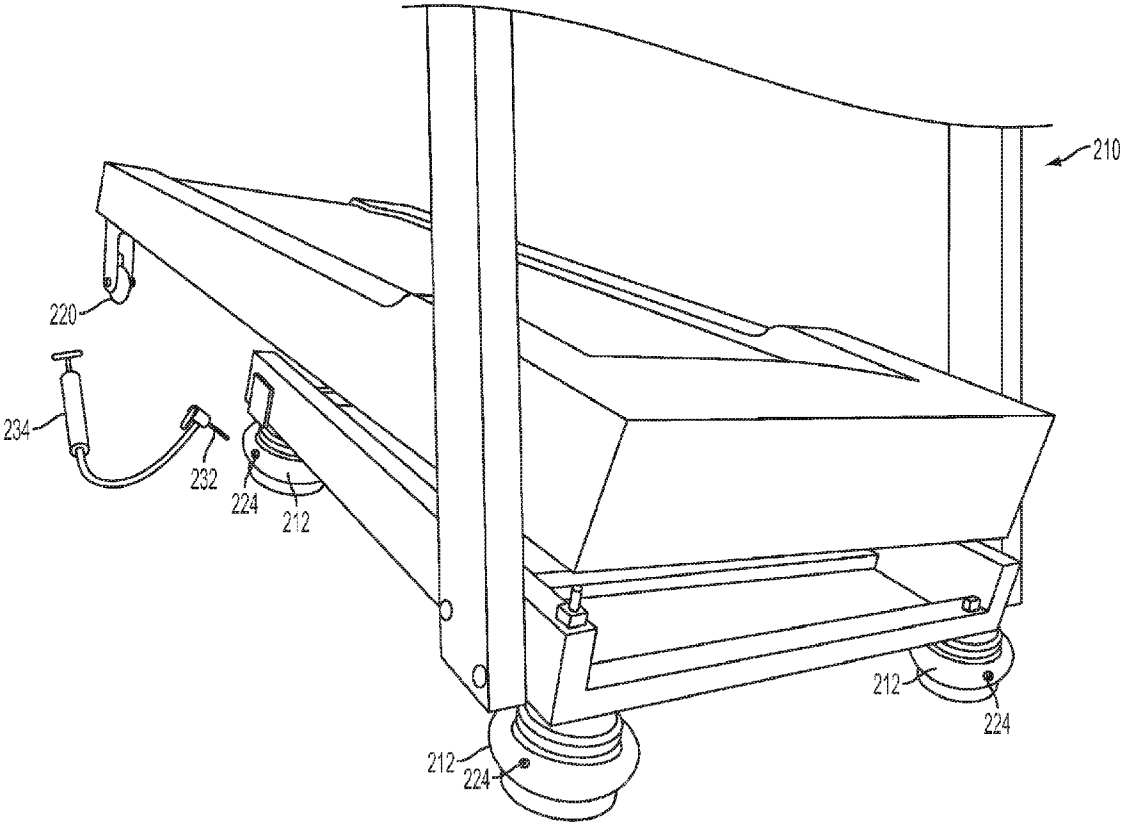
FIG. 5 is a perspective view of the lower portion of a second exemplary embodiment of the shock-absorbing treadmill of the present invention, wherein the air springs are inflatable and deflatable with a pump needle.

FIG. 5 is a perspective view of the lower portion of a second exemplary embodiment of the shock-absorbing treadmill 210 of the present invention, wherein the air springs 212 are inflatable and deflatable with a pump needle 232 attached to an air pump 234. Pump needle 232 is of the type conventionally used to inflate and deflate a basketball, football, or soccer ball. The pump needle 232 interfaces with a needle hole 224 in an air spring 212, to deliver or receive air from the air spring 212. Near the back end of the treadmill 210, rotatably mounted to the underside of the treadmill 210, are wheels 220. In this particular view, only one of the wheels 220 is visible.

Figure 6:
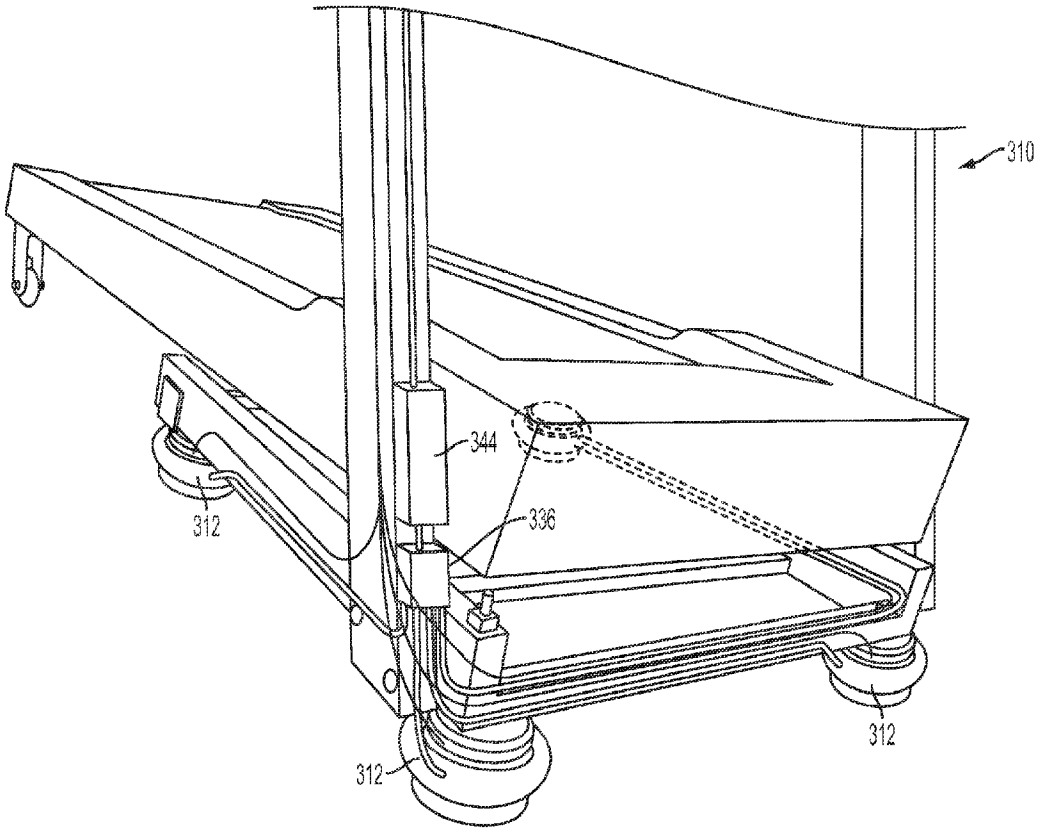
FIG. 6 is a perspective view of the lower portion of a third exemplary embodiment of the shock-absorbing treadmill of the present invention, having an air compressor and pressure sensor.

FIG. 6 is a perspective view of the lower portion of a third exemplary embodiment of the shock-absorbing treadmill 310 of the present invention, having an electronic air compressor 344 and pressure sensor 336. The air compressor 344 is connected in serial with pressure sensor 336, which is in turn connected to each air spring 312, one of which is shown in phantom. In other embodiments, each air spring has its own air compressor and pressure sensor. Also, in other embodiments, the air compressor and pressure sensor are combined in one housing. In other embodiments, the air compressor is located on the ground next to the treadmill instead of being mounted to the treadmill. The pressure sensor 336 senses the level of pressure in the air springs 312 and sends information about the pressure level to the air compressor 344 and an output device 350 on the dashboard 348 shown in FIG. 7.

Figure 7:
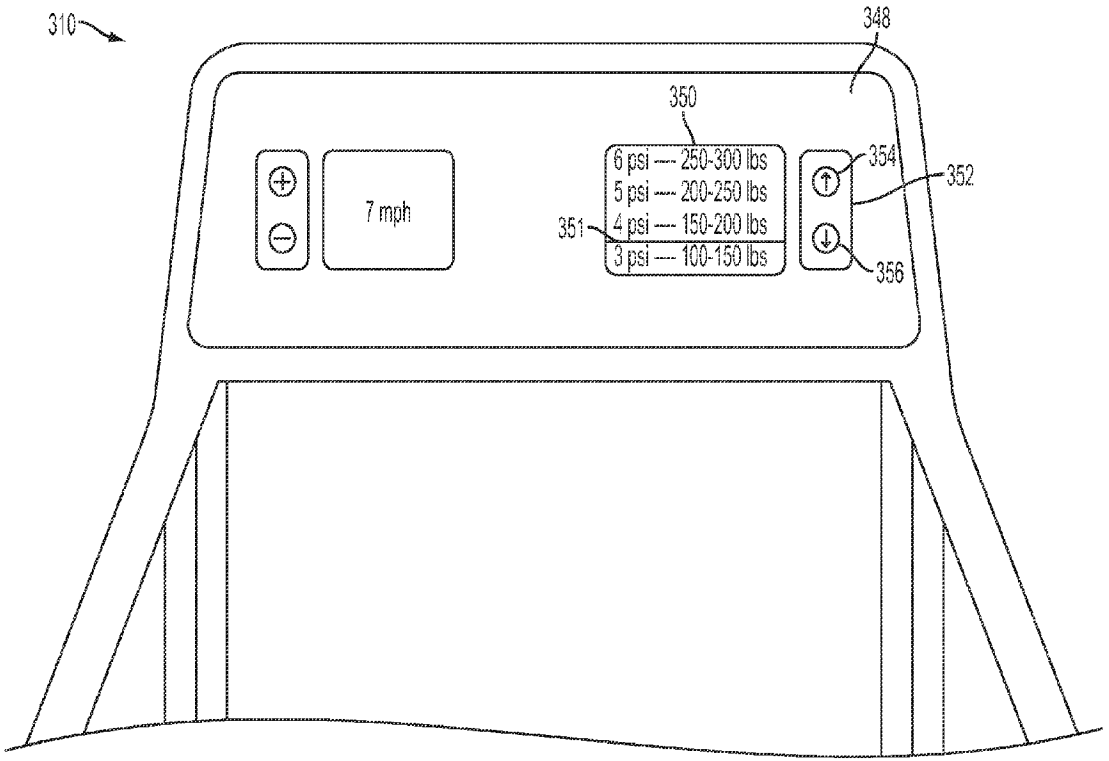
FIG. 7 is a front view of a dashboard of the third embodiment of a treadmill according to the present invention, with an output device for providing information about optimal pressure settings and a control panel for adjusting the pressure in the air springs.

FIG. 7 is a front view of a dashboard 348 of the third embodiment of a treadmill 310 according to the present invention, with an output device 350 adapted to provide information about the current pressure in air springs 312 (see FIG. 6), and optimal pressure settings for various weight ranges. The dashboard 348 also includes a control panel 352 for adjusting the pressure in the air springs 312. The control panel 352 includes an up arrow button 354, which, when pressed, causes an electrical signal to be sent to the air compressor 344, to deliver air to the air springs 312, thereby increasing the air pressure in each air spring 312. Pressing the down arrow button 356 causes an electrical signal to be sent to the air compressor 344 to release air from each air spring 312. It should be understood that in other embodiments, instead of up and down arrow buttons, the control panel may have a butterfly switch or other toggle for causing the air compressor to inflate or deflate each air spring. The pressure sensor 336 sends a signal to the output device 350 to display the current pressure in the air springs 312. In this embodiment, the output device 350 is a gauge which displays weight ranges in association with optimal pressures for the air springs 312. In this embodiment, a horizontal line 351 on the output device 350 signifies the pressure in the air springs 312 at any given moment.

Figure 8:
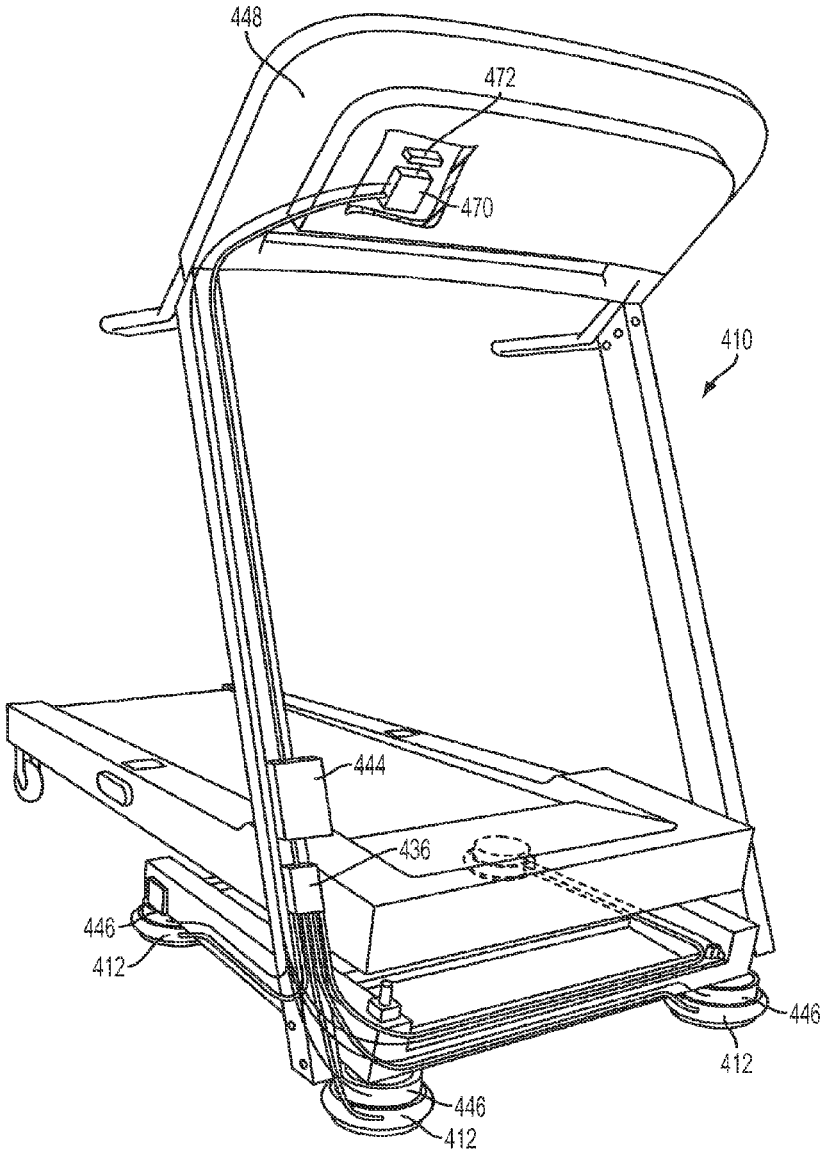
FIG. 8 is a perspective view of a fourth exemplary embodiment of the shock-absorbing treadmill having an air compressor, a pressure sensor, and a weight sensor.

FIG. 8 is a perspective view of a fourth exemplary embodiment of the shock-absorbing treadmill 410 having an air compressor 444 and a pressure sensor 436. Also included in each air spring 412 is a weight sensor 446. Located within the dashboard 448 is a microcontroller 470 with a computer memory 472. The microcontroller 470 receives information regarding the weight of a person standing on the treadmill 410. Next the microcontroller 470 determines the optimal pressure for the air springs 412, one of which is shown in phantom. The microcontroller determines the optimal pressure by accessing a lookup table of weights and associated pressures stored in the computer memory 472 and retrieving the pressure associated with the weight of the person. Next, the microcontroller 470 sends a signal to the air compressor 444 to inflate or deflate the air springs 412 to reach the optimal pressure. The dashboard 448 includes a control panel (not shown) and output device (not shown) like the control panel 352 and output device 350 shown in FIG. 7. All signals or information provided or received by the control panel, output device, weight sensor 446, pressure sensor 436, and air compressor 444 originate from, are received by, or pass through microcontroller 470.

While preferred embodiments of the disclosed subject matter have been described, so as to enable one of skill in the art to practice the present disclosed subject matter without undue experimentation, the preceding description is intended to be exemplary only. It should not be used to limit the scope of the disclosed subject matter.

The invention claimed is:

1. A shock-absorbing treadmill comprising:

a treadmill having length, a front end, a back end, a left side, a right side, and an underside;

a first air spring attached to the underside of treadmill at the front end, at the left side;

a second air spring attached to the underside of the treadmill at the front end, at the right side;

a third air spring attached to the underside of the treadmill approximately one-third of the length from the front end, at the left side;

a fourth air spring attached to the underside of the treadmill approximately one-third of the length from the front end, at the right side;

a first wheel rotatably connected to the underside of the treadmill at the back end, at the left side;

a second wheel rotatably connected to the underside of the treadmill at the back end, at the right side, whereby the treadmill is allowed to travel back and forth slightly as the front end of the treadmill moves up and down with each stride taken by a person exercising on the treadmill;

a weight sensor adapted to sense the weight of a person on the treadmill;

at least one pressure sensor adapted to sense a pressure within at least one air spring; and means for inflating or deflating at least one air spring.

2. The shock-absorbing treadmill of claim 1, wherein the means for inflating or deflating at least one air spring comprises at least one air compressor coupled to the at least one air spring.

3. The shock-absorbing treadmill of claim 2, further comprising a processor connected to a computer memory, wherein said processor is further connected to the weight sensor and an output device adapted to visually or audibly provide information, wherein said computer memory contains processor-executable instructions for:

electronically receiving information regarding a weight associated with a person located on the treadmill; and determining an optimal pressure for the at least one air spring based on the weight of the person.

4. The shock-absorbing treadmill of claim 3, wherein the computer memory further contains processor-executable instructions for:

providing information through the output device regarding the optimal pressure for the at least one air spring.

5. The shock-absorbing treadmill of claim 4, wherein the processor is further connected to the at least one air compressor and the at least one pressure sensor, and the computer memory further includes processor-executable instructions for:

detecting, via the at least one pressure sensor, the air pressure in the at least one air spring; and causing the at least one air compressor to inflate or deflate the at least one air spring until the at least one air spring has the optimal pressure.

6. The shock-absorbing treadmill of claim 4, further comprising a control panel attached to the treadmill and the processor, said control panel providing an interface adapted to allow a person to input a desired pressure in the at least one air spring, and wherein the computer memory further contains processor-executable instructions for:

detecting, via the at least one pressure sensor, the air pressure in the at least one air spring; and causing the at least one air compressor to inflate or deflate the at least one air spring until the pressure in the at least one air spring is equal to the desired pressure.

7. A method for adapting an existing treadmill having a length, a front end, a back end, a left side, a right side, and an underside, to be a shock-absorbing treadmill, the method comprising:

attaching a first air spring to the underside of treadmill at the front end, at the left side;

attaching a second air spring to the underside of the treadmill at the front end, at the right side;

attaching a third air spring to the underside of the treadmill approximately one-third of the length from the front end, at the left side;

attaching a fourth air spring to the underside of the treadmill approximately one-third of the length from the front end, at the right side;

rotatably connecting a first wheel to the underside of the treadmill at the back end, at the left side; and rotatably connecting a second wheel to the underside of the treadmill at the back end, at the right side, whereby the treadmill is allowed to travel back and forth slightly as the front end of the treadmill moves up and down with each stride taken by a person exercising on the treadmill;

providing a weight sensor adapted to sense the weight of a person on the treadmill; and providing at least one pressure sensor adapted to sense a pressure within at least one air spring.

8. A method for using a shock-absorbing treadmill having length, a front end, a back end, a left side, a right side, and an underside;

a first air spring attached to the underside of treadmill at the front end, at the left side;

a second air spring attached to the underside of the treadmill at the front end, at the right side;

a third air spring attached to the underside of the treadmill approximately one-third of the length from the front end, at the left side;

a fourth air spring attached to the underside of the treadmill approximately one-third of the length from the front end, at the right side;

a first wheel rotatably connected to the underside of the treadmill at the back end, at the left side;

a second wheel rotatably connected to the underside of the treadmill at the back end, at the right side;

a weight sensor adapted to sense the weight of a person on the treadmill; and at least one pressure sensor adapted to sense a pressure within at least one air spring, the method comprising:

standing or exercising on the shock-absorbing treadmill, and inflating or deflating the at least one air spring until the pressure sensed in the at least one air spring is substantially equal to a desired pressure.

9. The method of claim 8 for using a shock-absorbing treadmill, further comprising:

determining an optimal pressure for at least one air spring based on the sensed weight of a person who is or will be standing or exercising on the shock-absorbing treadmill;

wherein said inflating or deflating the at least one air spring is performed until the pressure in the at least one air spring is substantially equal to the optimal pressure.

10. The method of claim 9 for using a shock-absorbing treadmill, wherein the treadmill further comprises an output device and the step of determining an optimal pressure for the at least one air spring based on the sensed weight of a person who is or will be standing or exercising on the shock-absorbing treadmill comprises:

standing on the shock-absorbing treadmill; and receiving from an output device on the shock absorbing treadmill information regarding the optimal pressure for the at least one air spring.

11. The method of claim 10 for using a shock-absorbing treadmill, wherein the shock-absorbing treadmill further comprises:

at least one air compressor coupled to at least one air spring;

a processor connected to the at least one air compressor, the at least one pressure sensor; the weight sensor, and a computer memory, wherein said processor is further connected to the weight sensor, wherein said computer memory contains processor-executable instructions for:

electronically receiving information regarding a weight associated with a person located on the treadmill;

determining an optimal pressure for the at least one air springs based on the weight of the person; and detecting the air pressure in the at least one air spring; and inflating or deflating the at least one air spring until the at least one air spring has the optimal pressure;

and the method further comprises:

allowing or authorizing the shock-absorbing treadmill to inflate or deflate the at least one air spring until the pressure in the at least one air spring is substantially equal to the optimal pressure.

* * * * *